US005302175A

United States Patent [19]

Drummond

[11] Patent Number: 5,302,175

[45] Date of Patent: Apr. 12, 1994

[54] METHOD OF WINDING GLASS FIBERS

[76] Inventor: Warren W. Drummond, 3721 SW. 84th St., Gainesville, Fla. 32608

[21] Appl. No.: 938,693

[22] Filed: Sep. 1, 1992

[51] Int. Cl.[5] ..... C03B 37/03

[52] U.S. Cl. ..... 65/2; 65/10.1; 242/18.1

[58] Field of Search ..... 65/2, 10.1; 242/18.1, 242/4 A

[56] References Cited

U.S. PATENT DOCUMENTS

| | | | |
|---|---|---|---|
| 2,786,637 | 3/1957 | Russell et al. | 65/10.1 X |
| 2,866,310 | 12/1958 | Mackie . | |
| 3,041,663 | 7/1962 | Green . | |
| 3,041,664 | 7/1962 | Green . | |
| 3,120,689 | 2/1964 | Drummond . | |
| 3,151,963 | 10/1964 | Cochran | 65/10.1 |
| 3,430,312 | 3/1969 | Drummond . | |
| 3,482,953 | 12/1969 | Bohy | 65/2 |
| 3,547,362 | 12/1970 | Kallenborn | 242/18 |
| 3,933,456 | 1/1976 | Roberson | 65/10.1 |
| 4,033,741 | 7/1977 | Drummond | 65/2 |
| 4,045,195 | 8/1977 | Drummond | 65/2 |
| 4,307,497 | 12/1981 | Drummond | 28/271 |

*Primary Examiner*—Robert L. Lindsay
*Attorney, Agent, or Firm*—John E. Curley

[57] ABSTRACT

A method of preparing glass fiber strands is shown wherein the glass fibers as they are drawn from the glass fiber forming bushing are wound in a unique way. The fibers are drawn from the bushings using high speed, low energy drawing devices such as capstans and godets. They are then passed to high speed, low energy flyers for distribution onto the surface of light weight, low energy, slowing rotating mandrels. All the winding equipment and the attenuation devices are light in weight requiring very low horsepower motors compared to the high horsepower, high energy devices of the current state of the art. The flyers are shown driven by conventional motors or by a compressed air system. Collection of the strand takes place on the ends of the elongated mandrels shown and create a novel doughnut shaped forming package of fiber glass with properly distributed strands thereon suitable for unwinding.

14 Claims, 3 Drawing Sheets

METHOD OF WINDING GLASS FIBERS

The present invention relates to the manufacture of glass fibers. More particularly, the present invention relates to methods of collecting glass fibers as they are being formed. Still more particularly, the present invention relates to novel procedures for winding glass fibers at controlled low tension during their manufacture and the novel glass fiber packages which are produced thereby.

BACKGROUND OF THE INVENTION

In the manufacture of glass fiber strands as practiced today the emphasis is on increased productivity for each fiber forming position located on the forehearths of the furnaces used to process the raw glass making ingredients into molten glass. The glass, once molten, flows from the forehearth of the furnace through the fiber forming bushings which produce multiple streams of glass from a multiplicity of holes of precise dimension. These streams of molten glass solidify as they leave the bushing are gathered together to form strands after usually having a size or binder applied to them and are then collected on a paper or plastic tube which is rotated at high speed on the surface of a winding machine. The paper tube with the collected glass is slipped off of the winder when it is stopped upon completion of a package forming cycle.

The winder used to form the glass fiber packages are used both to wind the glass strands thereon and to impart the attenuation forces to the molten glass streams that are forming glass fibers as they emerge from the bushings. In a modern fiber glass manufacturing facility these winders operate at speeds that result in strands being collected at 12,000 to 20,000 feet per minute (3,658 to 6096 meters per minutes). In addition to operating at high speed, the winders are increasing in size and weight. The net result of the necessity to achieve high rates of production from the winding of the glass is that the costs of the winding equipment now represents a substantial capital investment in an industry that is already burdened with high capital costs for furnaces and the platinum alloys used to fabricate the bushings that produce the fibers.

Typical of the winders that are used to collect glass fiber strands in forming are those shown in U.S. Pat. Nos. 3,151,963, 3,041,663, and 3,547362. These winders are positioned below a forming bushing and after the strands are formed are rotated at high speeds to collect the product. The high collection speeds employed impart considerable tension to the strands that are collected which wrinkles the forming tubes used on the winder to collect the strands. High speeds also cause broken filaments, and more importantly, cause quality defects with inconsistent strands being poduced in the same package.

For these and other reasons a need exists to provide a method of winding strands of glass fibers that is less expensive than the high technology winders now employed but that will duplicate their productivity and minimize their product quality shortcomings. The instant invention satisfactorily meets that need.

SUMMARY OF THE INVENTION

In accordance with the instant invention strands of glass fibers under reduced tension are wound at the normal high speeds of conventional winding operations using cap spinners or flyers onto the surface of a slowly moving collecting surface. The strands may be acted upon before collection to consolidate them by passing them through an air jet system and if desired they may be dried as they are collected to minimize the migration of binder and sizes that have been applied to them as they were being formed.

The packages formed by the instant winding methods result in strands that are wound substantially on a flat collecting surface and at widths typically of 2 to 4 inches, (5 to 10 centimeters). The depth of the strands on the collectors is typically 0.5 to 3 inches or more. The configuration of the finished packages is in the shape of a doughnut.

Since the winding operation is accomplished utilizing light weight flyers in conjunction with light weight mandrels that move at relatively low speeds, low horsepower motors suffice. High speed winders used by the industry today which both attenuate and collect glass fibers require high horsepower to function. In addition, these current cumbersome winders require costly and sophisticated electronic equipment to control speeds and braking. Thus, considerable savings are realized in the power requirements necessary to process glass strands from the forming bushings to the winding surface. Using the instant invention the need for sophisticated electronic control is minimized. The collecting surfaces of the instant invention further are placed at an angle to the axis of rotation of the flyers that deliver the strand to the collecting surface so that the necessity of using the conventional spiral and traversing devices used today to pay glass strands on collectors is eliminated thus providing with the instant invention a considerably less harsh mechanical environment for the strands as they are processed.

BRIEF DESCRIPTION OF THE DRAWINGS

For a more complete understanding of the instant invention reference is made to the accompanying drawings in which.

DETAILED DESCRIPTION OF THE DRAWINGS

Figure 1:
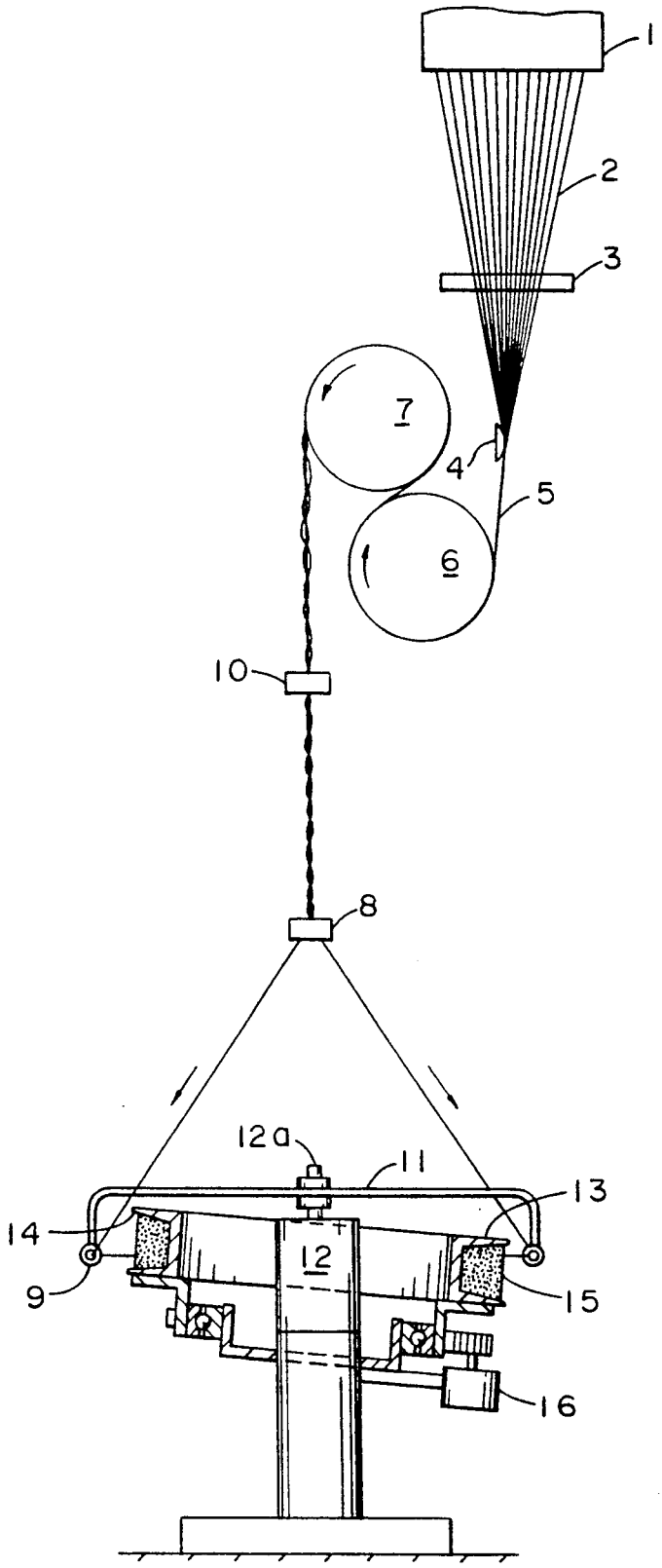
FIG. 1 is a side elevational, schematic illustration of a glass fiber forming station showing the bushing and the novel winding system of the instant invention, including the attenuator, the flyer, and the angled, rotatable strand collector.

Turning to the drawings and in particular to FIG. 1 there is shown a glass fiber forming bushing 1 having a plurality of orifices in the bottom thereof through which a multiplicity of glass fibers 2 are being drawn. The glass fibers in their descent are contacted with the surface of an applicator 3 which is used to apply a size or binder to the fibers as they contact it. This applicator 3 typically applies to the fibers 2 chemical ingredients which will render the finished strands suitable for a specific use i.e. as a reinforcement for a particular resin or as a textile fiber. The fibers 2 after they contact the applicator 3 are then contacted with a gathering shoe 4 which consolidates them into a strand 5. Strand 5 is passed around the two positively driven godets 6 and 7 which are driven by motors, not shown, at speeds sufficient to provide the necessary attenuative forces to insure the continuous attenuation of fibers 2 from bushing 1 at a constant forming speed.

The strand 5 after exiting the surface of godet 7 is delivered through the guide eye or ring 8 to the guide 9 on the flyer arm 11. Optionally, if desired, the strand 5 may be contacted with a consolidating air jet 10 prior to contacting it with the guide eye 8. A suitable jet for strand consolidation is shown in my U.S. Pat. No. 4,307,497. Motor 12 is provided to drive the flyer arm 11, by attachment of the arm 11 to the motor shaft 12*a*, in the conventional manner. The take up, mandrel 13 is provided on each end with a generally U-shaped groove or recess 14 in which the collector surface or forming tube 15 is placed. The mandrel 13 as shown, is positioned at an angle to the rotational axis of the flyer arm 11. Rotation of the mandrel by drive motor 16 is counter to the revolving flyer 11, which is the preferred mode of carrying out the instant invention.

In the operation of the method of the instant invention in accordance with the embodiment of FIG. 1, glass fibers 2 are drawn from the bushing 1 by the operator by hand and passed around the godets 6 and 7 which at the outset are rotating at low speeds. The strand is then passed by the operator through the guide 8 to the flyer arm guide 9. The flyer 11 the mandrel 13 and the godets 6 and 7 are brought up to operational speeds and the winding of the strand 5 is then begun and continued until the requisite amount of strand 5 has been wound on package 15.

Figure 2:
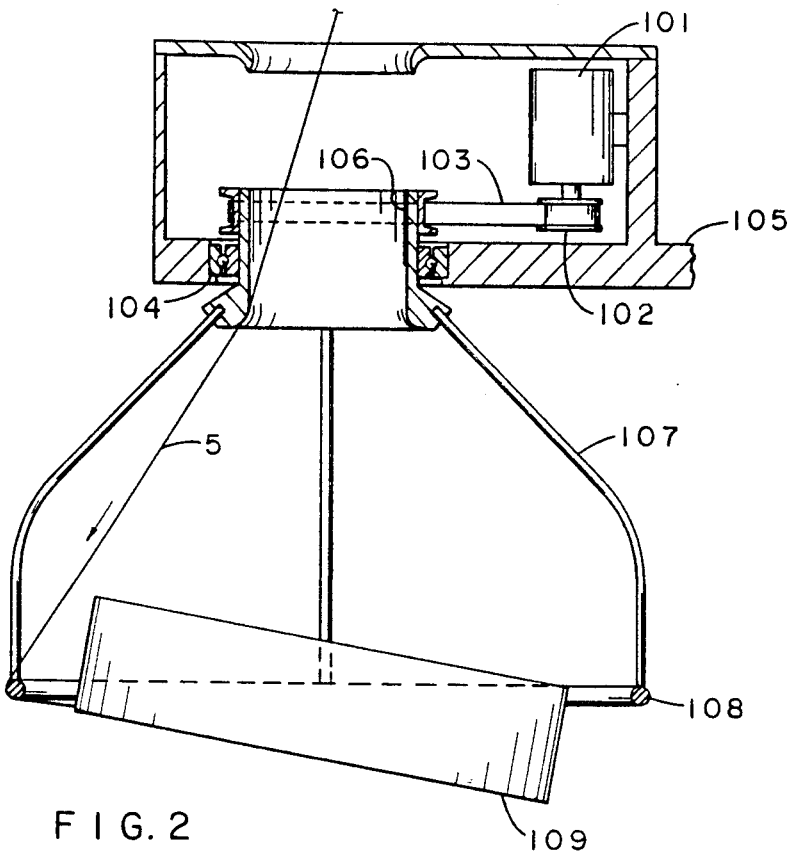
FIG. 2 is a side elevation of an alternative flyer to the flyer shown in FIG. 1.
Figure 2A:
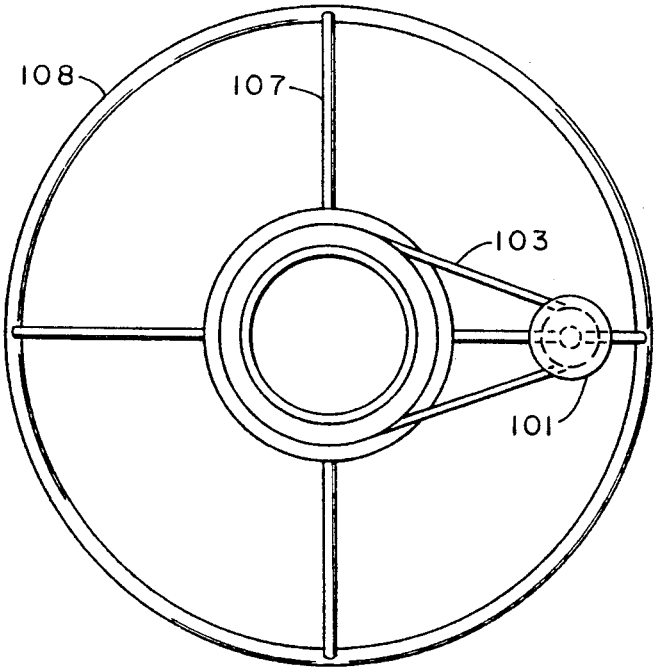
FIG. 2*a* is a plan view taken from above of the flyer of FIG. 2.

Turning now to FIG. 2 there is shown a side elevation of an alternative strand delivery means to that shown in FIG. 1. This embodiment of the invention permits the flyer to be driven from above and allows for the quick change of the mandrels used to collect the strand without the necessity of discontinuing the strand attenuation from the molten glass source. Thus, as shown, a motor 101 is provided which drives a pulley 102 and its associated belt 103. Bearing 104 is supported on the outside race by metal support 105 while belt 103 drives the inside race 106. Bearing race 106 serves as the driver ring in which support rods 107 are fixed. The ends of rods 107 support the flyer ring 108. FIG. 2*a* shows a top view of the ring assembly of FIG. 2. As can be seen from FIGS. 2 and 2*a*, the strand 5 is fed on the inside of the bearing race 106 and is then passed on the outside of the flyer ring 108. A stationary mandrel starting surface, not shown, is raised on the outside of the collecting mandrel 109 and coarse strand 5 is wound on it as the attenuation device (not shown) and the flyer ring 108 are brought up to speed. Once the desired attenuation and winding speeds have been realized the starting mandrel is lowered and the inside slowly rotating collection mandrel 109 takes up the winding of the strand 5 until the desired package weight is achieved in the manner shown and described above for FIG. 1.

Figure 3:
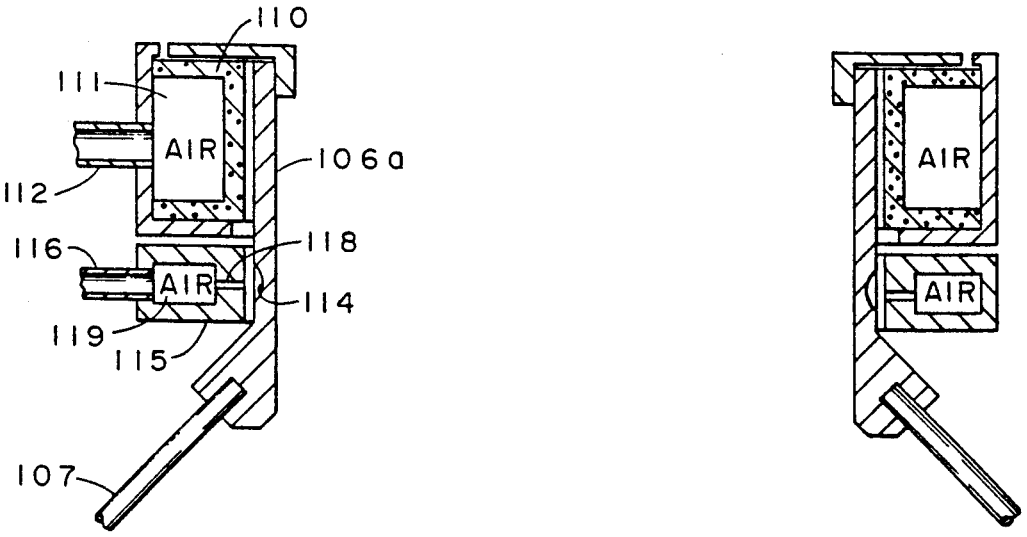
FIG. 3 shows an air bearing and air jet assembly for a flyer and its associate ring.

In FIG. 3 there is shown an alternative embodiment of the invention involving an air bearing for the driver ring 106 and a low energy power supply for the flyer ring 108 (not shown). In this embodiment a porous graphite or fine porous metal screen 110 is used to form a chamber 111 which is connected to a compressed air source through lines 112 and on this air bearing the driver ring 106*a* rides. The driver ring 106*a* is provided on its lower end with flutes 111 which are supplied continuously during operation with high pressure gaseous fluid, typically air, from air jets 115. The air jets 115 are supplied with the gaseous fluid from, for example, a compressed air source, not shown, via lines 116 and 117 to chamber 119 that communicates with flutes 111 through line 118. The flutes 114 are as shown tangential slots cut into the surface of the driver ring 106*a*. The remainder of the system is the same as that shown in FIG. 2 and functions in the same manner as the overall system of FIG. 2 with respect to the winding sequences employed to place strand on the winding surfaces of the collection mandrel 109.

Figure 4:
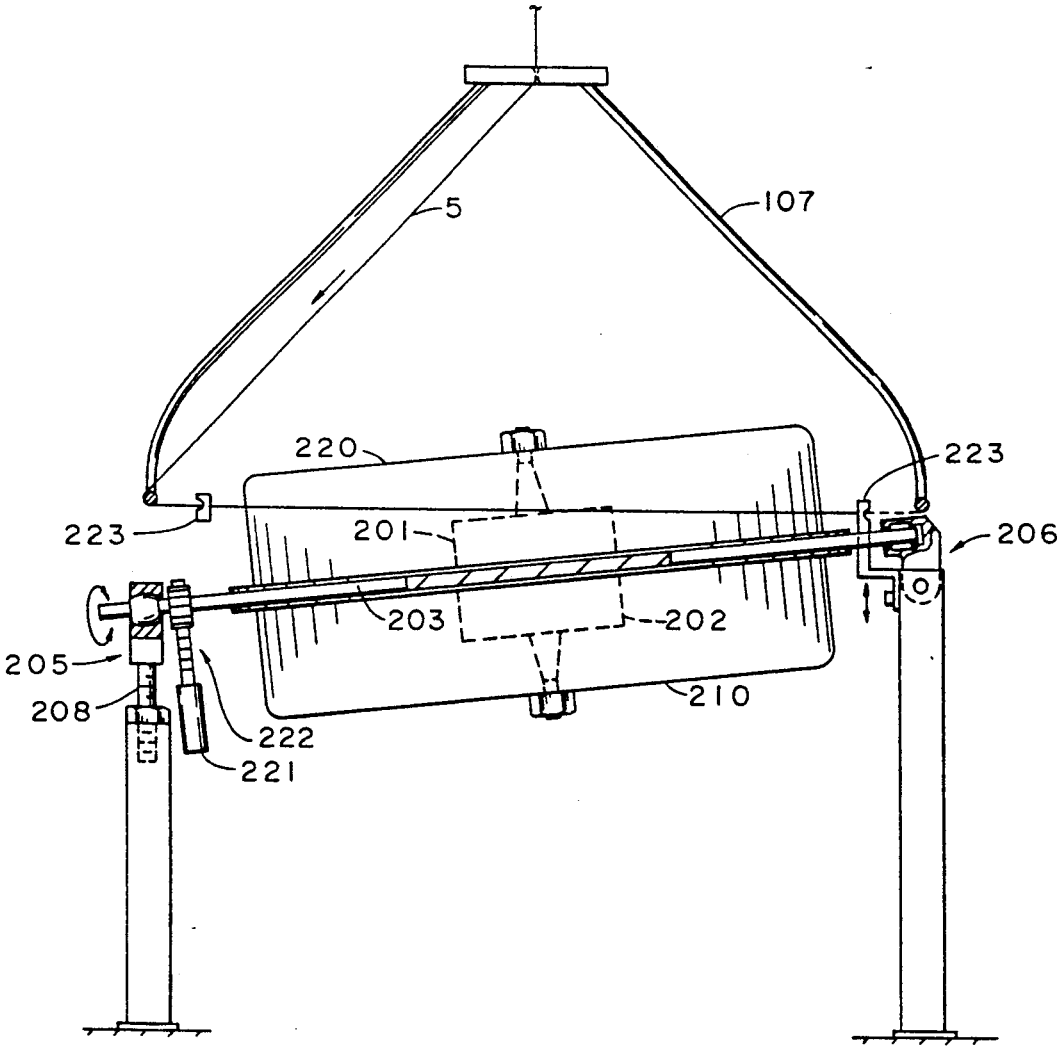
FIG. 4 is a side elevation of an arrangement of rotating mandrel and flyer that provides automatic package doffing to permit continuous winding.

In FIG. 4 an alternative method of continuous package filling is depicted. In this method two motors 201 and 202 are mounted on a shaft 203. The shaft 203 is supported at one end by support 205 and at the other by support 206. The shaft 203 is pivoted on the support 206 and is provided at its other end at support 205 with a threaded adjustment bolt 208 which can raise and lower the shaft 203 to adjust its pitch and the pitch of the winding surfaces of the mandrels 210 and 220 to which it and the motors 201 and 202 are attached. The motors 201 and 202 may be linked to the inside of the mandrels 210 and 220 by contact rubber roll driving bearings placed on the inside of the mandrel or by recourse to any other conventional mechanical arrangement to rotate the collector mandrels 210 and 220 from the drive motors 201 and 202. A rack and pinion rotator 222 for the mandrels is shown driven by an air cylinder 221. This rotator 222 operates to rotate the motor 201 to the position occupied by motor 202 when the package on mandrel 220 associated with that motor is completed. The mandrel 210 which is associated with motor 201 then begins collecting strand and when the package on mandrel 210 is completed the air cylinder reverses and the motor 201 is moved out of the collection area and the motor 202 and its associated mandrel 220 move back to collect further strand. When the mandrels 210 and 220 are not in the collecting area the packages on them are removed and they can be washed, cleaned and have new strand package collectors placed on their ends to prepare them for further strand collection. A transfer and start up collector ring is placed inside the same plane as the spinner ring and is divided so it can be raised on either side of the shaft 203 supporting the mandrels. This is raised and lowered at package change or doffing and at strand start up. A typical type of split ring that can be utilized is shown in U.S. Pat. No. 3,430,312 at FIGS. 13 and 14.

As can be seen, the instant invention can operate at attenuation strand speeds using low horsepower godets, capstans, grooved wheels and rollers of various types to apply the necessary tractive forces for attenuation of the glass fibers from their molten glass source, This eliminates the necessity of using cumbersome and expensive winders of the type now used to apply these forces. In like fashion the use of flyers to lay the strand on the collection surfaces at the attenuation speeds requires the use of low power motors since the winding device is light and is being fed from the attenuator instead of being the attenuator. The power which drives the flyer is controlled so that a proper winding tension is maintained on the strand being wound. This is normally held to a 50–150 gram range, far below conventional winding tensions of 300–1000 grams that cause severe problems in the wound package. The slow rotating mandrels can also be constructed of light weight metal or plastic, and since they rotate typically at 10 to 20 times slower than the flyer that is laying strand on them the power requirements used are slight compared to what is required today to move a high speed fiber glass winder that is attenuating the glass fibers and winding the strand product on its surface. The godets operate at conventional drawing speeds, i.e. 12,000 to 20,000 feet per minute. For operations involving a 24 inch mandrel collector the flyer would revolve at approximately 2,000 R.P.M. at 12,000 feet per minute drawing speed. A 24 inch mandrel typically operates at 50–400 R.P.M. for flyer rotating at 2,000 R.P.M. If the mandrel is rotated at 100 R.P.M. the flyer would only need to revolve 2,000–100 R.P.M. or 1,900 R.P.M. The mandrel will move 600 feet per minute and each wind of strand on the surface advances 600 feet/1,900 R.P.M. or 0.32 feet (approximately 4 inches). This provides progressive winding of uniform layers of traversed strand.

The packages formed are generally flat top packages. Any ridging at the ends can be reduced by ironing with contact rollers or by pitch changes of the mandrel.

The flyers used with this system can be revolved at sufficient rates to pass the strands to the collection surface when the strands are drawn at 12,000 to 20,000 feet per minute using low horsepower motors, ¼ horsepower or less. The motor is controlled to provide the strand tension desired for winding. Similarly, the mandrel can be constructed of light weight materials so that it may be driven with fractional horsepower motors. The godets also function with low horsepower drives. Compared to a typical modern winder operating at 20 horsepower, the energy savings can be substantial. This coupled with the ability to wind glass strand with minimal damage to the strand, makes the instant invention extremely attractive.

While the invention has been described with reference to certain specific examples and illustrated embodiments it is not intended that it be limited thereby except insofar as appears in the accompanying claims.

I claim:

1. A method of preparing glass fiber strand comprising applying sufficient tractive force to a plurality of glass fibers issuing from a molten glass source to attenuate the glass fibers at glass fiber forming speeds while gathering them into strand, feeding the strands so formed onto a flyer which encompasses a strand collection surface, revolving the flyer around the collection surface at speeds at least equal to the attenuation speed of the glass fibers using means other than the tractive forces used to attenuate the glass fibers, depositing the strands from the flyer onto the collection surface while rotating the collection surface at a speed slower than that of the flyer and in a direction counter thereto, maintaining the collection surface during the collection of the strand at an angle of from 2 up to 8 degrees to the revolving plane of the flyer to thereby impart a traversing laydown of the strand on the collection surface and collecting the strand on the collection surface as a substantially flat package.

2. The method of claim 1 wherein the glass fibers are contacted with an applicator to apply binder or size thereto prior to gathering them into a strand.

3. The method of claim 1 wherein the strand after being formed is consolidated by a high pressure fluid prior to being passed to the flyer.

4. The method of claim 2 where in the strand is consolidated by a high pressure fluid before passing it to the flyer.

5. The method of claim 1 wherein the flyer is rotated by a gaseous fluid under pressure sufficient to rotate the flyer at the speeds of the attenuation of the glass fibers and provide the desired winding tension to the strand.

6. The method of claim 1 wherein the strand is collected on the collecting surface to the desired depth and a second surface is then moved into the revolving plane of the flyer and associated rotating strand, moving the collected strand on the collecting surface away from the revolving plane of the flyer and associated strand simultaneously with the movement of the second surface into that plane and severing the strand between the two surfaces to thereby provide continuous attenuation of the glass fibers and collection of the strand formed therefrom.

7. A method of winding glass fiber strands on a substantially flat collection surface comprising drawing glass fibers from a molten glass source at a constant forming speed with an attenuation means that applies sufficient tractive forces to draw and gather the glass fibers into strand, delivering the strand so formed to a strand delivery means revolving at a speed at least equal to the glass fiber forming speed, passing the strand from the revolving strand delivery means onto the surface of a collector positioned in the plane of the revolving strand, the strand delivery means being driven independent of the attenuation means, maintaining the surface of the collector at an angle to the plane of the revolving strand, slowly rotating the collection surface to thereby cause the strand to traverse across the surface of the collector as it is wound thereon and collecting the strand on the collection surface to a desired depth.

8. The method of claim 7 wherein the collection surface is rotated countercurrent to the direction of the revolving strand.

9. The method of claim 7 wherein the strand is consolidated by high pressure gaseous fluid prior to being revolved by the strand delivery means.

10. The method of claim 8 wherein the strand is consolidated by high pressure gaseous fluid prior to being gathered into strand form are treated with a binder or size.

11. The method of claim 7, wherein the glass fibers before being gathered into strand form are treated with a binder or size.

12. The method of claim 8 wherein the glass fibers before being gathered into strand form are treated with a binder or size.

13. The method of claim 9 wherein the glass fibers before being gathered into strand form are treated with a binder or size.

14. The method of claim 10 wherein the glass fibers before being gathered into strand form are treated with a binder or size.

* * * * *